United States Patent [19]

Germann

[11] Patent Number: 5,036,763

[45] **Date of Patent: * Aug. 6, 1991**

[54] CONVERTIBLE MULTI-COLOR PRINTING MACHINE FOR THE RECTOVERSO PRINTING OF ESPECIALLY BANK NOTES

[75] Inventor: Albrecht J. Germann, Wurzburg, Fed. Rep. of Germany

[73] Assignee: De La Rue Giori S.A., Lausanne, Switzerland

[ * ] Notice: The portion of the term of this patent subsequent to Apr. 16, 2008 has been disclaimed.

[21] Appl. No.: 347,528

[22] Filed: May 4, 1989

[30] Foreign Application Priority Data

May 18, 1988 [CH] Switzerland ..... 1889/88

[51] Int. Cl.[5] ..... B41F 5/16; B41F 5/22

[52] U.S. Cl. ..... 101/177; 101/179

[58] Field of Search ..... 101/177, 178–185, 101/137, 138, 139–145, 217, 220, 221, 222

[56] References Cited

U.S. PATENT DOCUMENTS 4,640,189 2/1987 Hernandez ..... 101/179 X

FOREIGN PATENT DOCUMENTS 92887 11/1983 European Pat. Off. ..... 101/177

*Primary Examiner*—J. Reed Fisher

*Attorney, Agent, or Firm*—Kane Dalsimer Sullivan Kurucz Levy Eisele and Richard

[57] ABSTRACT

The printing machine is composed of two essentially identically constructed halves which each have an impression cylinder (4, 14), an image transfer cylinder (6, 16) resting against this, a blanket cylinder (7, 17) and a collect-printing plate cylinder (5, 15). In the offset-printing position, the blanket cylinder (7, 17) rests against the impression cylinder (4, 14) and is inked by offset plate cylinders, while the collect-printing plate cylinder (5, 15) is inoperative. In the collect-printing position, the blanket cylinder (7, 17) is moved away from the impression cylinder (4, 14), is inked by color selector cylinders (8, 18) and itself inks the collect-printing plate cylinder (5, 15) which rests against the image transfer cylinder (6, 16). Moreover, in both printing positions, the image transfer cylinder (6, 16) is inked by the plate cylinder (10, 20) of an additional single-color printing unit. The paper first loops partially round the impression cylinder (4) of the first machine half and is thereby printed directly on one side by the image transfer cylinder (6) and, in the offset-printing position, also by the blanket cylinder (7) and then loops partially round the impression cylinder (14) of the second machine half, the other side of the paper being printed in a similar way.

9 Claims, 2 Drawing Sheets

CONVERTIBLE MULTI-COLOR PRINTING MACHINE FOR THE RECTOVERSO PRINTING OF ESPECIALLY BANK NOTES

FIELD OF THE INVENTION

The invention relates to a convertible multi-color printing machine for the recto-verso printing of especially banknotes.

PRIOR ART

A printing machine of this type is known from EP-A-0,132,859. In this known machine, the first two cylinders of each machine half are blanket cylinders which are pressed against one another and interact as a recto-printing cylinder and a verso-printing cylinder and between which the paper to be printed is guided through, thereby being printed simultaneously on both sides. Since each of the two machine halves can work either by the offset-printing process or by the collect-printing process, this recto-verso printing machine provides selectively either a multi-color offset print on both sides of the paper or a multi-color collect print on both sides of the paper or else a multi-color offset print on one side of the paper and a multi-color collect print on the other side of the paper. This printing machine is intended especially for the production of banknotes, and the multi-color images produced either by the offset-printing process or by the collect-printing process represent particularly a safety background.

Whereas the collect-printing process provides images with colors lying next to one another, in the offset-printing process colors and part images can be superposed.

In this known printing machine, in offset printing the multi-color image obtained from the offset plate cylinders and transferred onto the blanket cylinder interacting with these offset plate cylinders is first also transferred onto the blanket cylinder functioning as a recto-printing cylinder or a verso-printing cylinder, before it passes from this onto the paper. In collect printing, the multi-color image of the inked collect-printing plate on the collect-printing plate cylinder is transferred, via the image transfer cylinder designed as a blanket cylinder, onto the blanket cylinder functioning as a recto-printing cylinder or verso-printing cylinder, before it passes from this onto the paper.

SUMMARY OF THE INVENTION

The object on which the present invention is based is to improve a convertible printing machine of the type described in the preamble of claim 1, in such a way as to reduce the number of ink transfers necessary in order to transfer the ink from the offset plate cylinders or from the collect-printing plate cylinder onto the paper.

According to the invention, this object is achieved by means of the features indicated in claim 1.

Moreover, preferably, in at least one of the machine halves there is an additional printing unit, preferably a wet-offset printing unit, of which the plate cylinder inked by its own inking unit inks the image transfer cylinder.

The advantage of the convertible printing machine according to the invention is that, both in offset printing and in collect printing, the blanket cylinder inked by the offset plate cylinders or the image transfer cylinder inked by the collect-printing plate cylinder transfers the multi-color image directly onto the particular side of the paper, so that there is no need for a transfer of the color image between blanket cylinders. Initially one side of the paper and then the other are thus printed in succession. Where an additional printing unit is concerned, moreover, a further single-color image can be applied in a single pass to one of the two sides or to both sides of the paper, in banknote printing this being especially a main design.

Although the two sides of the paper are printed in succession, a virtually perfect recto-verso printing register can be achieved, because the impression cylinders interacting as a recto-printing cylinder and a verso-printing cylinder are closely adjacent to one another and the paper is transferred directly from one impression cylinder to the other, thus guaranteeing a direct paper carry-over, without additional carry-over members. Preferably, at the same time, the arrangement is such that the distance between the two impression cylinders is adjustable according to the paper thickness and is selected so that the pressing force is at least approximately equal to that pressing force with which an impression cylinder and a blanket cylinder are pressed against one another to form a printing nip. This reliably guarantees a perfect carry-over of the paper, especially in sheet form, from one impression cylinder to the other.

BRIEF DESCRIPTION OF THE DRAWINGS

The invention is explained in detail by means of the drawing with reference to the exemplary embodiment of a sheet-fed printing machine. In the drawing.

DESCRIPTION OF THE PREFERRED EMBODIMENT

Figure 1:
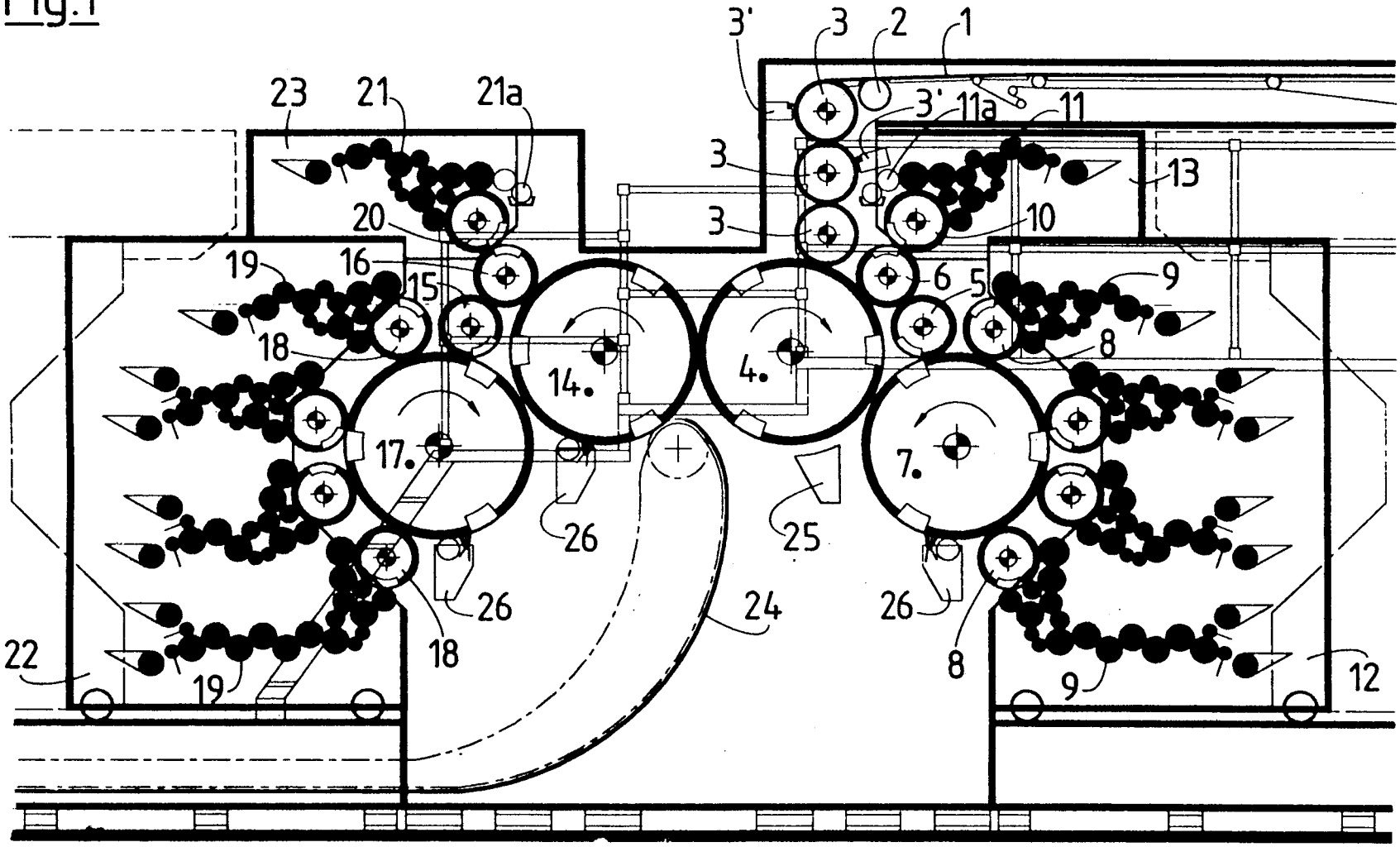
FIG. 1 shows an embodiment of the printing machine in which the two machine halves assume their collect-printing position.

The printing machine is composed of two machine halves which, with the exception of the devices feeding the paper and guiding the paper out of the machine, are of essentially identical construction. Each machine half has an impression cylinder 4, 14, a collect-printing plate cylinder 5, 15, an image transfer cylinder 6, 16 and a blanket cylinder 7, 17. Each blanket cylinder 7, 17 is inked by convertible cylinders 8, 18 which for offset printing are offset plate cylinders and for collect printing ar color selector cylinders and which are each inked with a different color by their own inking unit 9, 19. All the inking units 9 are installed in an inking-unit carriage 12 and all the inking units 19 are installed in an inking-unit carriage 22.

Figure 2:
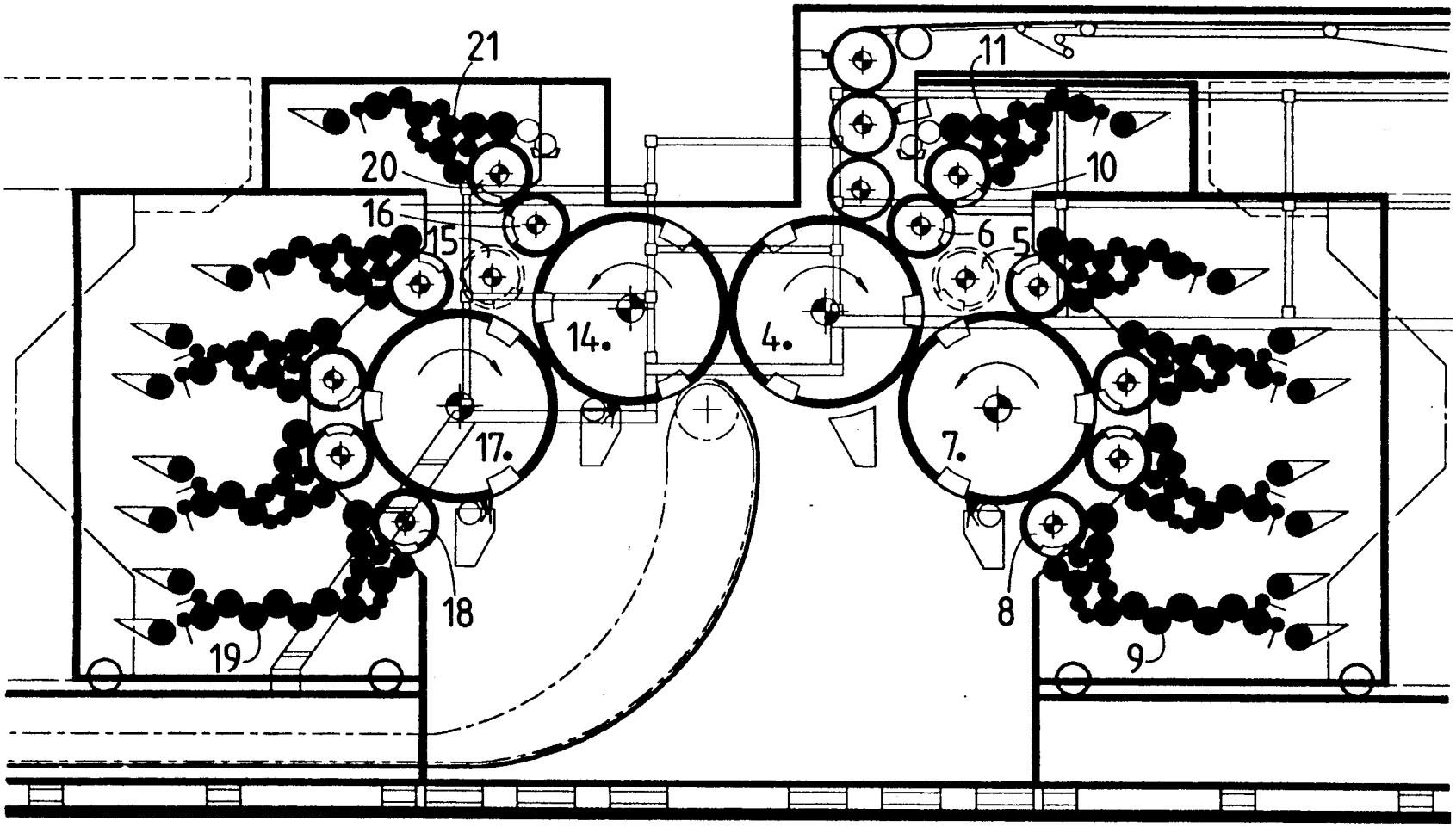
FIG. 2 shows the same printing machine with the two machine halves in the offset-printing position.

Furthermore, in the example under consideration, each machine half has an additional single-color printing unit, the plate cylinder 10, 20 of which rests against the image transfer cylinder 6, 16 and is inked by its own inking unit 11, 21. This additional single-color printing unit is an offset printing unit, preferably, as indicated in FIGS. 1 and 2, a wet offset printing unit which works with a dampening unit 11*a*, 21*a*. The wet offset printing plate used is preferably an intaglio printing plate, the non-printing surface of which is made ink-repellent as a result of the dampening. The inking unit 11 and the dampening unit 11*a* are accommodated in an inking-unit stand 13 which is arranged on top of the inking-unit carriage 12. The inking unit 21 and the dampening unit 21*a* on the other machine side are accommodated in an inking-unit stand 23 which is arranged on top of the inking-unit carriage 22.

The impression cylinders 4, 14 and the blanket cylinder 7, 17 rotate in the direction of the arrows. The paper 1 in sheet form is fed via a stop drum 2 and via transfer drums 3 equipped with grippers, at the same time passes paper-dedusting and anti-static devices 3' arranged on both sides, is then received by the impression cylinder 4 which functions as a recto-printing cylinder and on which it is held by mean of grippers, and loops round this impression cylinder 4 on its half which is the lower in the Figures; after the paper has passed through the nip between the two impression cylinders 4, 14, it is received by the grippers of the impression cylinder 14 functioning as a verso-printing cylinder and now loops round this in the other direction over most of its circumference, until it is finally received by a chain-gripper system 24 in the lower region of the impression cylinder 14 and guided out of the printing machine.

The blanket cylinders 7 and 17 are adjustable between a collect-printing position shown in FIG. 1, in which they are moved away from the respective impression cylinders 4, 14, and an offset-printing position shown in FIG. 2, in which they are pressed against the respective impression cylinders 4, 14.

In the collect-printing position shown in FIG. 1, the collect-printing plate cylinder 5, 15 assumes its working position, that is to say it rests both against the respective blanket cylinder 7, 17 and against the respective image transfer cylinder 6, 16 and carries a collect-printing plate which has a complete printing design and which is preferably a typographic printing plate. The convertible cylinders 8, 18 carry color selector plates. These color selector plates have cutout reliefs corresponding to those regions of the collect-printing plate to be printed in a specific color and transfer a multi-color image, with colors lying next to one another, onto the blanket cylinder 7, 17 which functions as a color-collecting cylinder and which itself inks the collect-printing plate cylinder 5, 15. The multi-color image is transferred from the inked collect-printing plate onto the image transfer cylinder 6, 16 which is a blanket cylinder. At the same time, in the example under consideration, this image transfer cylinder 6, 16 also receives the additional printing image from the plate cylinder 10, 20 of the additional single-color printing unit.

In each machine half, the image transfer cylinder 6, 16 and impression cylinder 4, 14 form between them a printing nip. The paper 1 first runs through the nip in the first machine half, being printed on one of its sides, and then through the nip in the second machine half, where it is printed on its other side.

In the offset-printing position shown in FIG. 2, the collect-printing plate cylinder 5, 15 assumes its moved-away inoperative position, the blanket cylinder 7, 17 is pressed against the impression cylinder 4, 14, and the convertible cylinders 8 and 18 carry offset printing plates, the part images of which are transferred onto the blanket cylinders 7 and 17.

In this offset-printing position each machine half has two printing nips, in particular a first nip between the impression cylinder 4, 14 and image transfer cylinder 6, 16 which, in this case, receives only the printing image from the plate cylinder 10, 20 of the additional single-color printing unit, and the second nip between the impression cylinder 4, 14 and blanket cylinder 7, 17. The paper 1 runs successively through the first and the second printing nip in the two machine halves, first on the impression cylinder 4 and then on the impression cylinder 14, first one side of the paper and then the other side respectively receiving the single-color print and the multi-color offset print.

Since the two printing cylinders 4 and 14 are closely adjacent to one another and the paper sheets are thereby carried over directly from one impression cylinder to the other, without additional paper guide means, a virtually perfect recto-verso printing register is guaranteed, despite the fact that the printings take place in succession. In order reliably to guarantee the in-register carry-over of the paper from the impression cylinder 4 to the impression cylinder 14, the distance between the two impression cylinders is adjustable according to the paper thickness and is preferably selected so that the pressing force is at least approximately equal to that pressing force with which an impression cylinder 4, 14 and the respective blanket cylinder 7, 17 are pressed against one another to form a printing nip.

In the example under consideration, the impression cylinders 4, 14 and the blanket cylinders 7, 17 are of the same size and have a diameter which is an integral multiple of, in the example under consideration three times, the diameter of the collect-printing plate cylinders 5, 15, image transfer cylinders 6, 16, plate cylinders 10, 20 and convertible cylinders 8, 18. The two blanket cylinders 7, 17 are lower than the impression cylinders 4, 14 and are arranged respectively offset obliquely outwards in relation to these; the collect-printing plate cylinders 5, 15 and the image transfer cylinder 6 16 are located above the blanket cylinder 7, 17. Thus, the entire region below the blanket cylinder 7, 17 and the impression cylinders 4, 14 is free of inking cylinders and is therefore easily accessible.

Since the diameter of the impression cylinders 4, 14 is an integral multiple of the diameter of the plate cylinders 8, 18, the fresh color images printed onto the first side of the paper, when they come up against the second impression cylinder 14, always come in contact with the same circumferential portions of this impression cylinder 14 during each revolution of the latter. Consequently, possible transfers of ink from the freshly printed first side of the paper onto the second impression cylinder 14 do not, in principle, cause disruption, because the color designs possibly transferred during each revolution of the impression cylinder 14 always coincide.

However, in order reliably to prevent the possibility that the printing quality will be impaired as a result of such ink transfers, it is possible to ensure that an ink transfer from the freshly printed side of the paper onto the second impression cylinder 14 does not occur. For this purpose, as indicated in the Figures, in the vicinity of the circumferential portion of the first impression cylinder 4 covered by the freshly printed paper there can be a drying device 25 which dries the fresh printing ink before it comes in contact with the surface of the second impression cylinder 14. A similar drying device can also be installed at the second impression cylinder 14. These drying devices are appropriately equipped with a means for temperature regulation. Quick-drying printing inks can also be used, and a drying device 25 can be employed in order to accelerate this drying.

Another possibility for preventing an ink transfer from the freshly printed first side of the paper onto the second impression cylinder 14 is to equip this impression cylinder 14 with an at least approximately ink-repellent surface which is composed, for example, of a metal layer in the manner of a wet offset printing plate, dampened by means of a dampening unit.

However, as already mentioned, a certain transfer of ink onto the surface of the second impression cylinder 14 can be allowed for, but in that case mackling should be prevented by covering the second impression cylinder 14 with offset rubber blankets, giving the first impression cylinder 4 a hard surface and, as mentioned, pressing the two impression cylinders so firmly against one another that the sheets are clamped and thus guided correctly during the passage from one impression cylinder to the other. At the same time, an excessive accumulation of ink on the rubber surface of the second impression cylinder is prevented because an ink equilibrium is established between the rubber and the paper. It is also possible to provide, on the surface of the impression cylinder 14, a layer of chromium with a micro-fine grain which easily rejects again the ink received by the freshly printed side of the paper, so that a non-disruptive ink equilibrium is established between this chromium layer and the printed paper side resting on it.

Whereas the impression cylinder 4 which is the first in the direction of run of the paper, that is to say the recto-printing cylinder, always preferably has a hard surface, especially a metallic surface, for example of steel, the choice of the surface of the impression cylinder 14 which is the second in the direction of run of the paper, that is to say the verso-printing cylinder, depends on whether and, if appropriate, what means are provided to prevent a transfer of ink onto this impression cylinder. If the work is carried out with a drying device 25, as mentioned, or with a quick-drying ink, the second impression cylinder 14 can have the same hard surface, especially of steel, as the first impression cylinder 4. If the surface of the second impression cylinder 14 is to be made ink-repellent, then, as mentioned, it has a surface layer in the manner of a wet offset printing plate. If ink transfers onto the second impression cylinder 14 are allowed, then, as mentioned, it is possible, for example, to provide a rubber-blanket surface or else a chromium layer with a micro-fine grain.

In the example under consideration, the two blanket cylinders 7 and 17 and also the second impression cylinder 14, assumed to be covered with rubber blankets, are each equipped with a removable automatic blanket-washing device 26 which is, of course, moved away from the cylinder during the printing operation. If a second impression cylinder 14 used is covered with rubber blankets, there is no need for the drying device 25.

Of course, the printing machine described can also be operated in such a way that one machine half assumes its offset-printing position and the other machine half its collect-printing position. Also, it is possible to equip only one of the two machine halves with an additional single-color printing unit. On the other hand, along the free circumferential portions of the impression cylinders 4 and 14 it is also possible to provide one or more further single-color printing units, the images of which are each transferred directly onto the particular side of the paper via an image transfer cylinder with an elastic surface.

In banknote printing, the multi-color offset-printing or collect-printing images preferably form the safety background, whilst the additional single-color printing units designed as wet offset printing units and having the plate cylinders 10, 20 supply a main design. Besides the main design, the plate cylinders of these additional printing units can also have a further safety-background design supplementing and, if appropriate, superposed on the multi-color safety background.

Apart from the advantage that the colors or the images are transferred from the plate cylinders directly onto one side of the paper or the other via only one respective blanket cylinder, the printing machine according to the invention is distinguished in that it makes it possible to print banknotes with a high degree of safety against counterfeiting. This high degree of safety against counterfeiting is achieved, on the one hand, because the multi-color safety background can be produced on one banknote side by a different printing process from that on the other banknote side, and furthermore the main design on each banknote side can, in turn, be generated by a different printing process, particularly the wet offset printing process, and, on the other hand, because, by means of an additional background design, a highly complicated safety background composed of mutually superposed lines can be produced on the printing plates of the additional single-color printing units.

The printing machine described can also be designed as a web-fed printing machine, in which case the sheet guide members are merely replaced by the known guide members for a paper web and, if continuous printing is envisaged, the two impression cylinders 4 and 14 each have a continuously smooth seamless surface.

I claim:

1. A convertible multi-color printing machine for the recto-verso printing on paper, comprising:

a first and a second cooperating impression cylinder (4, 14) arranged and constructed to pass said paper (1) therebetween and to apply a multi-colored image on a respective side of said paper;

a plurality of inking units (9), each inking unit having a different color;

a plurality of convertible cylinders (8), each convertible cylinders being inked by a corresponding inking unit (9);

converting means for converting said convertible cylinders (8) to one of color selecting cylinders and offset plate cylinders;

a first and a second blanket cylinder (7, 17) having a periphery, with said convertible cylinders (8) being arranged around and in contact with said periphery;

blanket cylinder mounting means for selectively mounting said first and said second blanket cylinder into one of an offset printing position in which said first and said second blanket cylinders (7, 17) contacts one of said first and second impression cylinders (4), and a collect printing position in which first and second blanket cylinders (7, 17) are spaced away from said first and second impression cylinders (4, 14);

first and second image transfer cylinders (6, 16) in contact with said one of said first and second impression cylinders (4, 14) for applying a multi-colored image thereon;

a first and a second collect plate cylinder (5, 15) carrying a collect printing plate;

collect plate mounting means for selectively mounting said first and said second collect plate cylinders (5, 15) to an operative position and an inoperative position, in said operative position said first and second collect plate cylinders (5, 15), respectively, being in contact with said first and second blanket cylinders (7, 17), respectively so that said first and second collect printing plate cylinders (5, 15) are inked by said first and second blanket cylinders (7, 17), respectively, in said collect printing position, and with said first and second image transfer cylinders (6, 16) for picking up said multi-colored image; and an additional single-color printing unit having an additional plate cylinder (10) with a single color image and an additional inking unit (11), said additional single-color printing unit being in contact with one of said first and second image transfer cylinders (6, 16) for transferring said single color image thereto;

means for conveying said paper (1) to be printed first through a nip formed between said first impression cylinder (4) and said first image transfer cylinder (6) and through a nip formed between said first impression cylinder (4) and said first blanket cylinder (7), then through a nip formed between said first and second impression cylinders (4, 14) and then through a nip formed between said second impression cylinder (14) and said second image transfer cylinder (16) and through a nip formed between said second impression cylinder (14) and said second blanket cylinder (17).

2. A convertible multi-color printing machine for the recto-verso printing on paper, comprising:

a first and a second cooperating impression cylinder (4, 14) arranged and constructed to pass said paper (1) therebetween and to apply a multi-colored image on a respective side of said paper;

a first and second group of inking units (9, 19) of different colors;

a first and a second group of convertible cylinders (8, 18), each convertible cylinders being inked by a corresponding inking unit (9, 19);

converting means for converting said convertible cylinders (8, 18) to one of color selecting cylinders and offset plate cylinders;

a first and a second blanket cylinder (7, 17) each having a periphery, with said convertible cylinders (8, 18) being arranged around and in contact with the periphery of one of said blanket cylinders (7, 17);

blanket cylinder mounting means for selectively mounting said first and second blanket cylinders (7, 17) into one of an offset printing position in which each of said blanket cylinders (7, 17) contact one of said first and second impression cylinders (4, 14), and a collect printing position in which said first and second blanket cylinders (7, 17) are spaced away from said first and second impression cylinders (4, 14);

a first and a second image transfer cylinders (6, 16), each being in contact with one of said first and second impression cylinders (4, 14), respectively, for applying a multi-colored image thereon;

a first and a second collect plate cylinder (5, 15) each carrying a collect printing plate;

collect plate mounting means for selectively mounting said first and second collect plate cylinders (5, 15) to an operative position and an inoperative position, in said operative position each of said first and second collect plate cylinders being in contact with said first and second blanket cylinders (7, 17), respectively, so that the respective collect printing plate is inked by one of said first and second blanket cylinders (7, 17) in said collect printing position, and with of one said first and second image transfer cylinders (6, 16) for picking up said multi-colored image; and two additional single-color printing units, each having additional plate cylinders (10, 20) with a single color image and an additional inking unit (11, 21), each said additional single-color printing unit being in contact with one of said first and second image transfer cylinders (6, 16) for transferring said single color image thereto;

means for conveying said paper (1) to be printed first through a nip formed between said first impression cylinder (4) and said first image transfer cylinder (6) and through a nip formed between said first impression cylinder (4) and said first blanket cylinder (7), then through a nip formed between said first and second impression cylinders (4, 14) and then through a nip formed between said second impression cylinder (14) and said second image transfer cylinder (16) and through a nip formed between said second impression cylinder (14) and said second blanket cylinder (17).

3. A printing machine as claimed in claim 2 wherein said first and second impression cylinders (4, 14) include drying means (25).

4. A printing machine as claimed in claim 2 wherein said second impression cylinder (14) includes a metallic surface.

5. A printing machine as claimed in claim 2 wherein said first impression cylinder (4) includes a metallic surface, said second impression cylinder (14) includes an offset rubber blanket, and wherein said first and said second impression cylinders (4, 14) press against each other thereby providing in-register guidance for said paper.

6. A printing machine as claimed in claim 2, where said second impression cylinder (14) has an ink-repellant surface.

7. A printing machine as claimed in claim 6 wherein said ink-repellant surface comprises a metal layer with a dampening means, said ink repellant surface thereby acting as a wet offset printing plate.

8. A printing machine as claimed in claim 2, wherein said second impression cylinder (14) has a surface of chromium with a micro-fine grain.

9. A printing machine as claimed in claim 8 wherein said impression and blanket cylinders (4, 14, 7, 17) have a diameter three times larger than the diameter of said collect plate cylinders (5, 15, 10, 20).

* * * * *